US005257077A

United States Patent [19]

Peters, Jr. et al.

[11] Patent Number: 5,257,077

[45] Date of Patent: Oct. 26, 1993

[54] TONER DISPENSING APPARATUS FOR A XEROGRAPHIC REPRODUCTION MACHINE

[75] Inventors: Henry B. Peters, Jr., Webster; John M. Wysocky, Rochester; Anthony C. Fornalik, Webster, all of N.Y.

[73] Assignee: Xerox Corporation, Stamford, Conn.

[21] Appl. No.: 829,094

[22] Filed: Jan. 31, 1992

[51] Int. Cl.[5] ..... G03G 15/06

[52] U.S. Cl. ..... 355/260; 222/DIG. 1

[58] Field of Search ..... 355/260; 222/DIG. 1

[56] References Cited

U.S. PATENT DOCUMENTS

| | | | |
|---|---|---|---|
| 3,724,725 | 4/1973 | Stauffer | 222/240 |
| 4,212,264 | 7/1980 | Knechtel et al. | 222/DIG. 1 X |
| 4,641,945 | 2/1987 | Ikesue et al. | 355/260 |
| 4,739,907 | 4/1988 | Gallant | 222/240 |
| 4,878,603 | 11/1989 | Ikesue et al. | 222/DIG. 1 X |
| 4,943,830 | 7/1990 | Sulenski | 355/245 |
| 4,951,094 | 8/1990 | Bell et al. | 355/245 |
| 4,965,639 | 10/1990 | Manno et al. | 355/260 |
| 4,969,011 | 11/1990 | Faull et al. | 355/208 |
| 4,978,997 | 12/1990 | Bell | 355/253 |
| 5,057,872 | 10/1991 | Saijo et al. | 355/260 |
| 5,084,734 | 1/1992 | Yoshino et al. | 355/260 |

*Primary Examiner*—A. T. Grimley
*Assistant Examiner*—Nestor R. Ramirez

[57] ABSTRACT

A toner cartridge is provided for dispensing toner on demand to the development station of a xerographic copier machine. The cartridge is modified so as to improve the dispensing of toner through dispensing ports located at one end of the cartridge by the provision of a relatively stiff, coiled spring element which is fixed in position adjacent the interior walls of the cartridge. As the cartridge rotates, the spring moves through the toner acting as an auger-type transport mechanism to move the toner towards the dispensing ports. The spring also serves to agitate the toner so as to make its consistency more fluid thereby aiding the augering transport motion. In one embodiment, the toner cartridge is tilted so as to utilize additional gravitational forces to assist in the toner transport towards the dispensing end.

6 Claims, 2 Drawing Sheets

TONER DISPENSING APPARATUS FOR A XEROGRAPHIC REPRODUCTION MACHINE

BACKGROUND AND MATERIAL DISCLOSURE STATEMENT

The present invention relates to a toner dispenser in a xerographic reproduction machine developer station and, more particularly, to a rotating dispenser which incorporates a fixed internal helical-type spring to improve the toner dispensing.

In prior art xerographic reproduction machines, the toner material used to develop a latent image formed on a photoreceptor surface is consumed in a development process and must be periodically replaced within the development system in order to sustain continuous operation of the machine. One technique which has become generally accepted is the use of a separate toner or developer hopper incorporating a toner cartridge for dispensing the toner into a hopper on a continuous, or on an on-demand basis. In addition, it has become common practice to use a toner cartridge, which, when placed in the machine, can be automatically opened to dispense toner. In such systems, a difficulty may arise in uniformly dispensing the toner from the cartridge, since the toner particles may tend to agglomerate, become compacted, and form a bridging structure in the toner container.

Various techniques have been developed to enable a reliable dispensing of toner from toner cartridges. U.S. Pat. Nos. 4,951,094 and 4,969,011 disclose toner developing systems in which toner cartridges are periodically rotated so that toner is dispensed through a series of ports extending along the length of the cartridge. U.S. Pat. Nos. 4,739,907; 4,943,830; and 3,724,725 disclose dispensing systems wherein the toner cartridge is stationary and an internal coil member is rotated to order the toner to a dispensing end, the rotating member additionally serving an anti-bridging function. U.S. Pat. No. 4,965,639 discloses a rotating cartridge which is slightly inclined to the horizontal so that toner is gravity-fed to dispensing ports located at one end. This system, however, lacks a toner transport and an anti-bridging mechanism.

The present invention is directed towards a dispensing system which dispenses toner on demand. The dispensing system includes a toner cartridge, which is periodically rotated to dispense toner through an exit port at a dispensing end. The toner in the cartridge is transported towards a dispensing end, while simultaneously being mixed and fluffed to assist such transport, by the action of an internal, coiled spring, which is held in place along the interior surface of the cartridge. As the cartridge rotates, the spring acts to both auger the toner towards the dispensing end and to keep the toner in a fluid-like condition to assist the toner movement towards the dispensing end. More particularly, the present invention relates to a xerographic reproduction machine which includes:

a movable recording member on which latent electrostatic images are created, developing means for developing said images with toner, and transfer means for transferring the developed images to a copy substrate material, said developing means including a developer housing adjacent said recording member with means in said housing to bring developer from a sump in said housing into developing relation with said recording member to develop images on said recording member, said developing means characterized by including a toner dispensing apparatus for periodically dispensing toner into said sump comprising in combination:

a cylindrical toner cartridge positioned above said sump and containing a supply of toner therein, said cartridge having a plurality of toner discharge ports at one end thereof, drive means for periodically rotating said cartridge, and a relatively stiff, coiled spring member fixedly attached along the interior surface of the cartridge and extending along the length of the cartridge, said spring element adapted to transport the toner within the cartridge towards the dispensing end during rotation of the cartridge while simultaneously mixing the toner and making the consistency of the toner more fluid-like.

DESCRIPTION OF THE INVENTION

Figure 1:
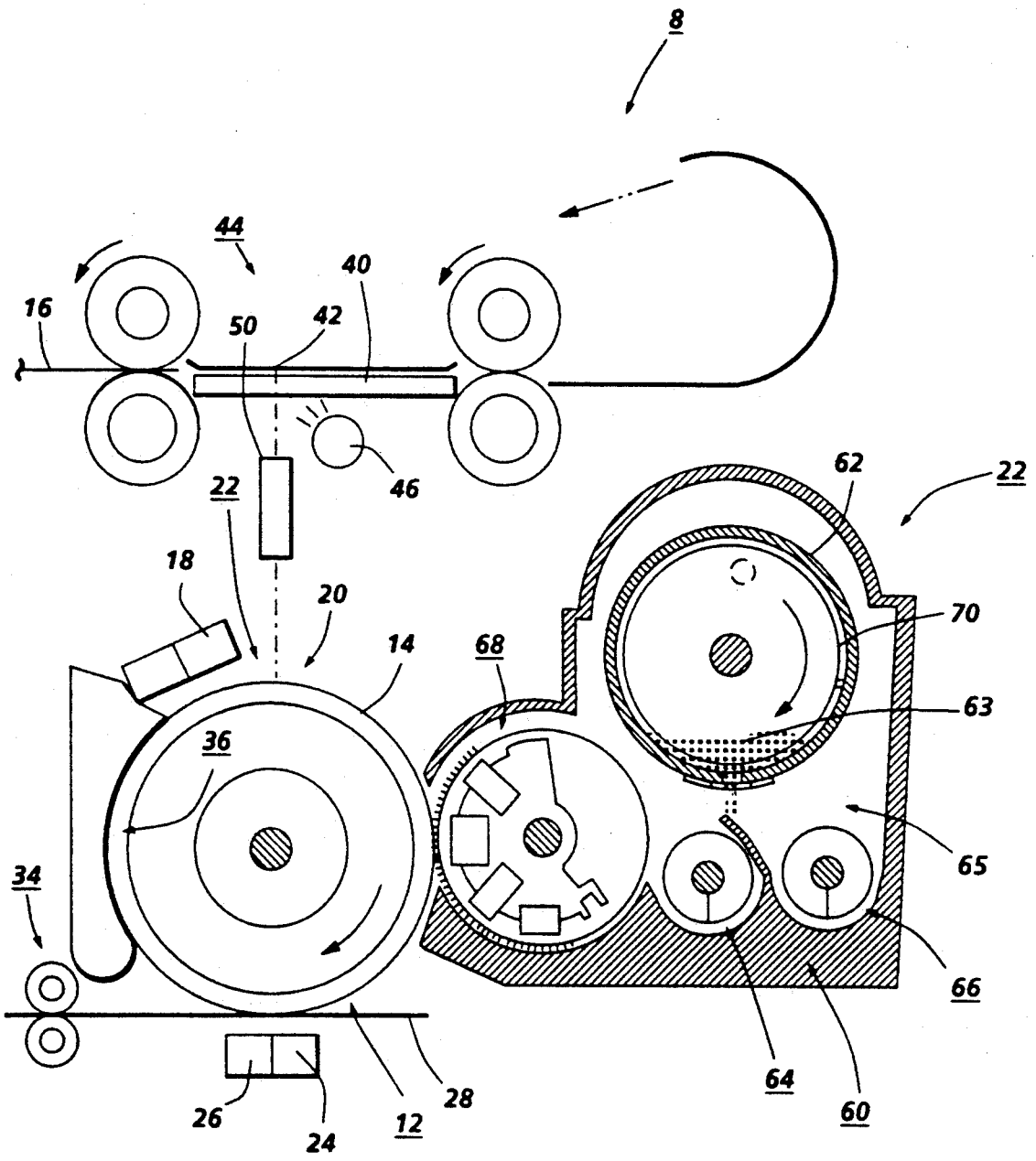
FIG. 1 is a side view of a reproduction machine incorporating the toner dispensing apparatus of the present invention.

Referring to FIG. 1 of the drawings, there is shown a xerographic type reproduction machine 8 incorporating the toner dispensing apparatus of the present invention. Machine 8 has a suitable frame (not shown) on which the machine xerographic components are operatively supported. Briefly, and as will be familiar to those skilled in the art, the machine xerographic components include a recording member, shown here in the form of a rotatable photoreceptor 12. In the exemplary arrangement shown, photoreceptor 12 comprises a drum having a photoconductive surface 14. Operatively disposed about the periphery of photoreceptor 14 are a charge corotron 18 for placing a uniform charge on the photoconductive surface 14; an exposure station 20 where the previously charged photoconductive surface 14 is exposed to image rays of a document 16 being copied or reproduced; development station 22 where the latent electrostatic image created on photoconductive surface 14 is developed by toner; and transfer detack corotrons 24 and 26 for assisting transfer of the developed image to a suitable copy substrate material such as a copy sheet 28 brought forward in timed relation with the developed image on photoconductive surface 14. Residual toner is removed from the drum surface at cleaning station 36.

Following transfer, the sheet 28 is carried forward to a fusing station where the toner image is fixed by fusing roll pair 34. After fusing, the copy sheet is discharged to an output tray (not shown).

A transparent platen 40 supports the document 16 as the document is moved past a scan point 42 by a constant velocity type transport 44. As will be understood, scan point 42 is in effect a scan line extending across the width of platen 40 at a desired point along the platen where the document is scanned line by line as the document is moved along platen 40 by transport 44. Exposure lamp 46 is provided to illuminate a strip-like area of platen 40 at scan point 42. The image rays from the document line scanned are transmitted by a gradient index fiber lens array 50 to exposure station 20 to expose the photoconductive surface 14 of the moving photoreceptor 12.

Developer station 22 includes a developer housing 60 in which a toner dispensing cartridge 62, containing preloaded toner particles 63, is rotatably mounted to turn in the indicated clockwise direction so as to dispose toner particles contained therein into a sump area 65, in which are positioned a pair of rotatably mounted augers 64, 66. The augers conventionally mix the toner with a developer mixture within the sump and transport the developer into the vicinity of magnetic brush applicator brush 68, which applies a developer mixture to the latent image formed on the photoconductive surface. Further details of the operation of the augers and the magnetic brush applicator are found in U.S. Pat. No. 4,978,997, whose contents are hereby incorporated by reference.

Figure 2:
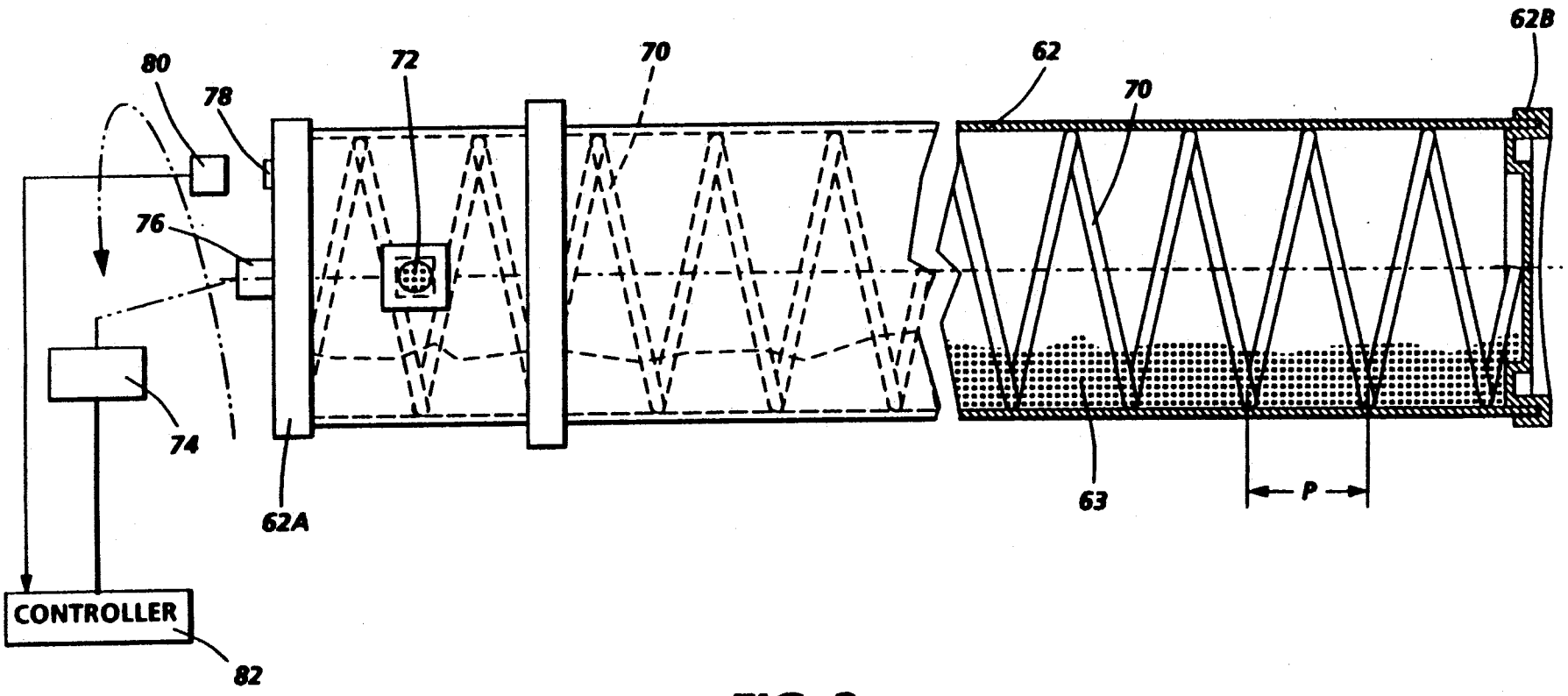
FIG. 2 is a side view of one of the toner dispensing cartridge of FIG. 1 showing the arrangement of an internally located augering spring.

As shown in end view in FIG. 1 and in cross-sectional side view in FIG. 2, a stiff spring element 70 is fixedly positioned along the inside length of cartridge 62. Referring to FIG. 2, cartridge 62 is enclosed at both ends by end caps 62A, 62B. A series of dispensing ports 72 are located at one end of cartridge 62. The cartridge is rotated by a motor 74 attached to shaft hub 76. A magnet 78 is attached to the outside of end cap 62A. A magnetic switch 80 is positioned to be in line with magnet 78 on each rotational cycle. Each time the cartridge completes a full rotation, a signal is sent from switch 80 to controller 82 which delays the next cartridge rotation for some predetermined time period. Controller 82 also operates in a predetermined relationship with other components of machine 8 to control machine functions and timing as disclosed in aforementioned U.S. Pat. No. 4,978,997.

Spring 70 comprises a coiled, relatively stiff, spring-like member which is attached to the inside end cap 62A of the cartridge by filament tape or the like. Once attached to the end cap, the coiled spring remains fixedly in place along the length of the cartridge contacting the inside wall surfaces of the cartridge. The diameter of spring member 70 is selected to be slightly less than the diameter of cartridge 62 to provide a snug fit along the length of the cartridge. A preferred material for spring 70 is metallic or toner-compatible plastic. The pitch distance P between the coils of spring 70 has been set at some optimum distance, in this case 35 mm but a range of between 10 and 75 mm would provide optimum toner mixing and transport. The cross-sectional diameter of the wire is preferably within 2 and 4 mm. Still referring to FIG. 2, the spring 70 is fixed to end cap 62A so as not to cover any of the dispensing ports 72.

In operation, as the cartridge turns through a dispensing cycle, the toner is transported towards the dispensing end by the augering action of spring 70 as it is turned along with the cartridge. Spring 70 also serves a second function, that of continually slicing through the toner 63 as it collects at the bottom of the cartridge to maintain the toner in a fluffed and more fluid-like consistency, thereby enabling a better "flow" of the toner towards the dispensing end.

While the embodiment shown in FIGS. 1 and 2 utilized a toner cartridge fixed in a horizontal plane, the invention may also be used with a cartridge which is slightly tilted about a midpoint, with respect to the horizontal. The dispensing port sector 72A would be selected so that that end of the cartridge is below the horizontal. With this embodiment, a gravitational force cooperates with the augering action of the spring to move the toner towards the dispensing port sector 72A. An additional advantage of this embodiment is a relaxation of the tolerances which must be observed in initial leveling of the machine frame 8.

While the invention has been described with reference to the structures disclosed, it is not confined to the details set forth, but is intended to cover such modifications or changes as they come within the scope of the following claims. Although the preferred embodiment calls for a coiled spring-like member, the invention may be practiced, albeit, less efficiently, with a transport and mixing member or plurality of members comprising segmented, linear coils which are fixed in place along the interior circumference of the cartridge. This configuration, however, while it provides the mixing action, does not provide the required augering action.

What is claimed is:

1. In a xerographic reproduction machine which includes:

a movable recording member on which latent electrostatic images are created, developing means for developing said images with toner, and transfer means for transferring the developed images to a copy substrate material, said developing means including a developer housing adjacent said recording member with means in said housing to bring developer from a sump in said housing into developing relation with said recording member to develop images on said recording member, said developing means characterized by including a toner dispensing apparatus for periodically dispensing toner into said sump comprising in combination:

a cylindrical toner cartridge enclosed at both ends and positioned above said sump and containing a supply of toner therein, said cartridge having a plurality of toner discharge ports located along the length of the cartridge, drive means for periodically rotating said cartridge, and a single relatively stiff, coiled spring member having a coil diameter slightly less than the diameter of the cartridge thus causing the spring member to remain fixedly in place along the length of the cartridge and contacting the inside wall surfaces of the cartridge, said coiled spring member adapted to transport the toner within the cartridge towards the discharge ports during rotation of the cartridge while simultaneously mixing the toner and making the consistency of the toner more fluid like.

2. The reproduction machine of claim 1 wherein said coiled spring member is positioned so as not to overly any of said discharge ports.

3. The reproduction machine of claim 1 wherein said coiled spring member has a plurality of coils separated from each other by a pitch distance P between a range of 10 and 75 mm.

4. The reproduction machine of claim 1 further including means for rotating said cartridge on a periodic, on-demand basis.

5. The reproduction machine of claim 1 wherein said toner cartridge is aligned in a horizontal plane.

6. The reproduction machine of claim 1 wherein said cartridge is aligned along a plane at an angle to the horizontal with the toner discharge ports being below the horizontal.

* * * * *